United States Patent [19]

Mahanay et al.

[11] Patent Number: 4,907,420

[45] Date of Patent: Mar. 13, 1990

[54] DUAL WALL EVAPORATOR PAN

[75] Inventors: Herbert S. Mahanay, Waterloo; Russell W. Hoeffken, Belleville, both of Ill.

[73] Assignee: Snyder General Corporation, Red Bud, Ill.

[21] Appl. No.: 205,733

[22] Filed: Jun. 13, 1988

[51] Int. Cl.[4] ..... F25D 21/14

[52] U.S. Cl. ..... 62/291; 62/285

[58] Field of Search ..... 62/285, 291; 220/410, 220/420, 469

[56] References Cited

U.S. PATENT DOCUMENTS

| | | | |
|---|---|---|---|
| 2,450,305 | 9/1948 | Shoemaker | 62/291 X |
| 2,682,754 | 7/1954 | Eck | 62/285 X |
| 4,047,633 | 9/1977 | Trombly | 220/469 |
| 4,083,198 | 4/1978 | Dennis | 62/285 |
| 4,478,349 | 10/1984 | Haverland, Jr. et al. | 220/410 |
| 4,687,604 | 8/1987 | Goettl | 62/291 X |
| 4,756,446 | 7/1988 | Gen et al. | 220/469 X |

FOREIGN PATENT DOCUMENTS

| | | | |
|---|---|---|---|
| 1219016 | 5/1960 | France | 62/285 |

*Primary Examiner*—Lloyd L. King

*Attorney, Agent, or Firm*—Rogers, Howell & Haferkamp

[57] ABSTRACT

An evaporator pan assembly comprises an inner pan having walls defining a pan capable of containing water. An outer pan has walls surrounding at least most of the walls of the inner pan, and there is an air space between the inner pan and outer pan walls. One end wall of the inner pan is movable relative to the adjacent outer pan end wall.

13 Claims, 2 Drawing Sheets

DUAL WALL EVAPORATOR PAN

BACKGROUND OF THE INVENTION

This invention relates to an evaporator pan assembly for an air conditioning or heat pump system and is particularly directed to an evaporator pan constructed to eliminate the accumulation of moisture on the outside wall of the pan.

An evaporator pan is incorporated in air conditioning systems to collect condensate that drips from an evaporator coil and to direct the condensate to a suitable drain. The evaporator pan may be installed in various orientations depending upon the design of the refrigeration system and frequently this orientation has the evaporator pan tilted at a 45° angle to accommodate an inclined evaporator.

Typically, an evaporator is located in a room of a building in which the air is at a temperature much higher than that of the evaporator inasmuch as the purpose of the evaporator is to cool the room air. As a result, moisture from the room air condenses onto the side surfaces of the evaporator. The evaporator pan, which is always installed at the lower end of the evaporator, collects this condensation as it flows down the sides of the evaporator. In these installations, the evaporator pan is kept relatively cold by the condensate water from the evaporator. Therefore, moisture in the warmer room air condenses on the outer surface of the evaporator pan.

In all evaporator pan installations, an ongoing problem in the industry has been the dripping of water as a result of this collection of moisture on the outer surface of the evaporator pan. Depending upon temperature and humidity conditions, the quantity of this dripping water has ranged to severe quantities that have damaged floors, walls and equipment in areas which are reached by the dripping or flow of condensate. The condensate could also drip water onto electrical components within the air conditioner or heat pump system and increase the possibility of electrical shock or failure.

Various efforts have been made to solve this problem of condensation on the evaporator pan. In the conventional evaporator pan construction, the pan is made of a single wall of metal or plastic. In most installations, insulating tape is applied to the outer surface of the wall and/or the outer surface is sprayed with an insulating material of a thickness between ⅛ and ¼ inch. Some of these practices encounter environmental problems. These and other efforts to solve the problem of condensation on the outer surface of an evaporator pan have been ongoing for many years.

In the development of the dual wall evaporator pan that will be described hereinafter, the inventors have overcome a number of problems. Foremost is the problem of accumulated moisture on the outer surface of the pan which problem is eliminated by the present invention. Also resolved has been the problem of how to cope with contraction of the inner wall relative to the outer wall in view of the coefficient of expansion of the plastic material of which the evaporator pan is molded and the temperature differences between the inner and outer walls.

Still further is a solution to the problem of how to provide for a dual wall construction with an insulating air space between the walls with sealed joints to enclose the air space that nevertheless accommodates the contraction of the colder inner wall relative to the warmer outer wall.

In addition, the invention provides a dual wall evaporator pan that solves the problem of how to incorporate an air flow barrier at the bottom of the evaporator while retaining the insulating air space.

SUMMARY OF THE INVENTION

This evaporator pan assembly comprises an inner pan and an outer pan. The inner pan has side walls, end walls and a bottom wall. The outer pan has side walls, and a bottom wall, and may have only one end wall. The upper edges of the inner pan are provided with a continuous laterally outwardly extending ledge that overlies the upper edges of the outer pan so that the two can be joined together in an air-tight seal.

Preferably, the junction is provided by an interlock fixed in place by a plastic solvent. No connections are made between the inner and outer pans below the upper edges. This allows the end of the inner pan to move relative to the end of the outer pan to accommodate contraction of the inner pan relative to the outer pan. Thus, one end is fixed and the other end is floating or free to move and flex, thus eliminating restraint against contraction of the inner wall relative to the outer wall which otherwise would fracture the joint areas between the inner and outer walls. The air trapped between the inner and outer pans acts an insulating medium and moisture buildup on the outer surface of the evaporator pan assembly is essentially eliminated. Preferably, the outer surface of the outer pan is textured to further eliminate the accumulation of moisture by increasing the area of evaporation surface.

DETAILED DESCRIPTION OF PREFERRED EMBODIMENT

Figure 1:
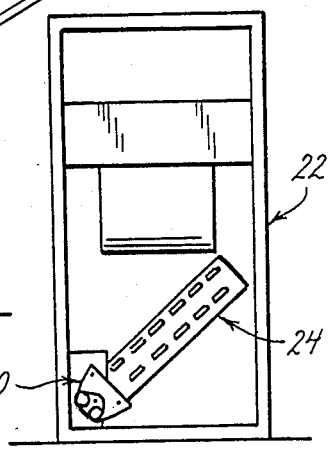
FIG. 1 is a schematic diagram showing the installation of the evaporator pan assembly of this invention with an evaporator coil.

As shown in FIG. 1, this evaporator pan assembly 20 is shown installed in a refrigeration system housing 22 tilted at about a 45° angle to accommodate an inclined evaporator coil assembly 24. In this installation, as is conventional, the evaporator pan assembly 20 would be connected by an appropriate tubing (not shown) to allow collected evaporator coil condensate to flow to a suitable drain (also not shown).

Figure 2:
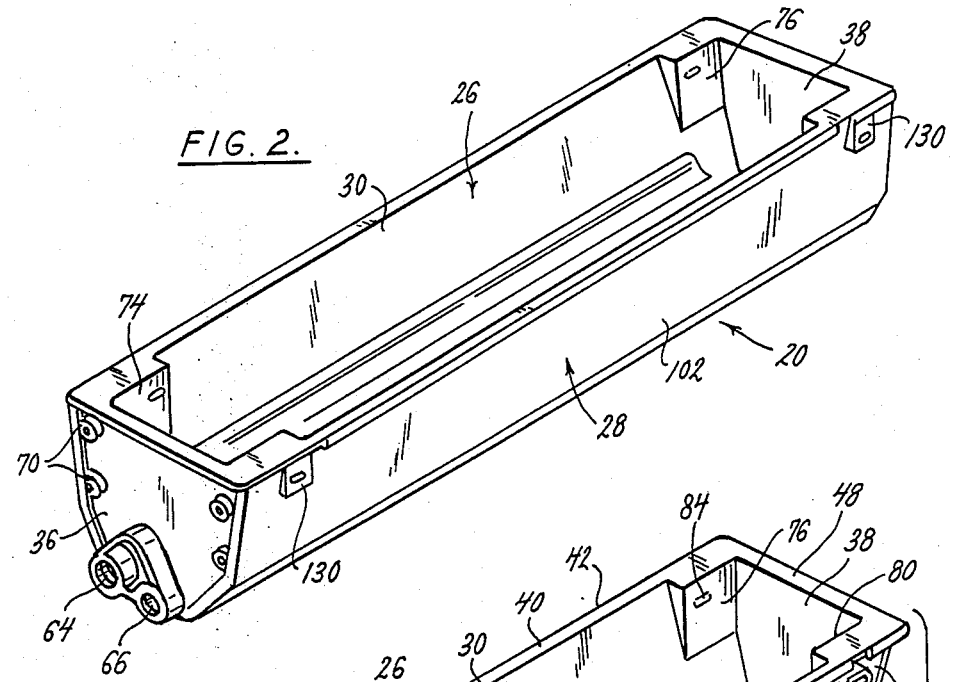
FIG. 2 is a perspective view of the evaporator pan assembly.
Figure 3:
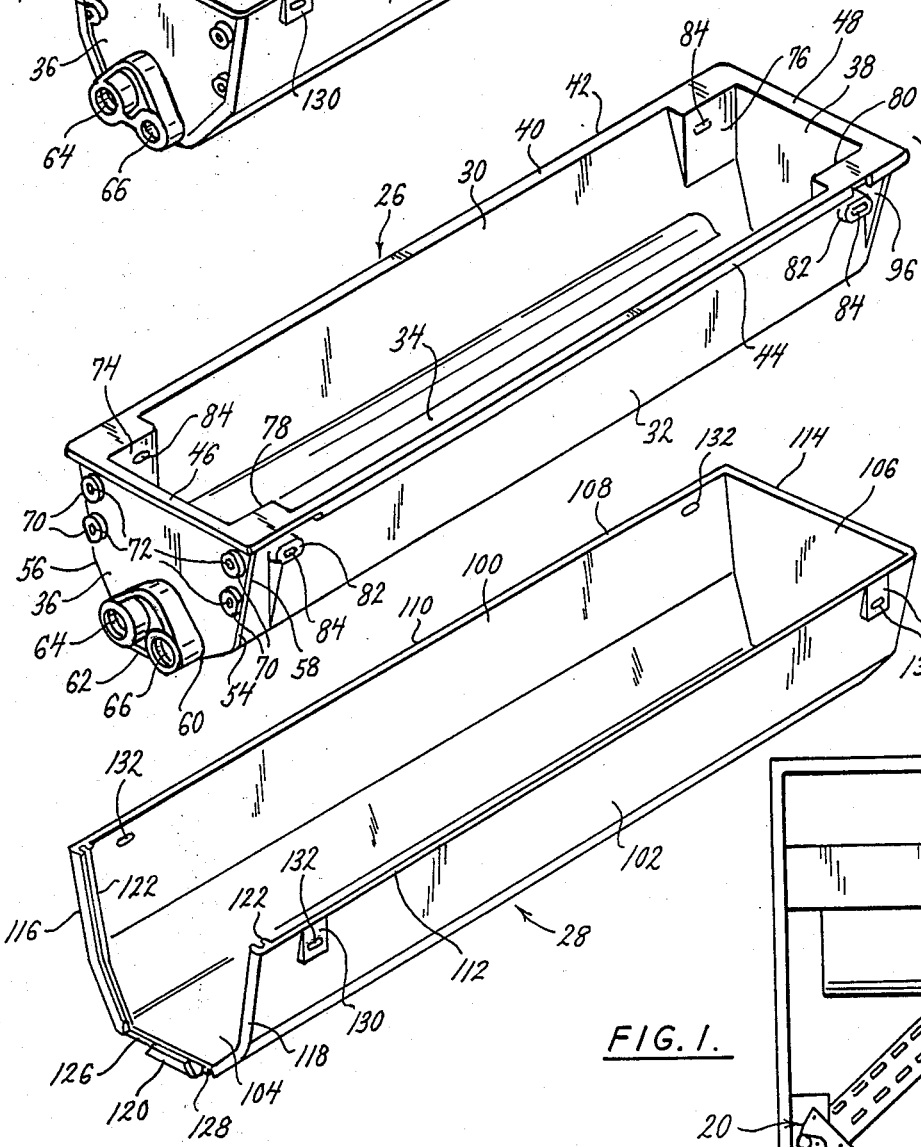
FIG. 3 is an exploded perspective view of the inner and outer pans of the evaporator pan assembly.

Referring more particularly to FIGS. 2 and 3, the evaporator pan assembly 20 includes an inner pan 26 and an outer pan 28. The inner pan 26 has elongated sloping sidewalls 30 and 32 that slope inwardly toward a bottom wall 34 and it has end walls 36 and 38. There is a continuous laterally outwardly projecting ledge 40 about the perimeter of the outer pan 26 that includes sections 42 and 44 at the upper edges of the side walls 30 and 32 joined to sections 46 and 48 at the upper edges of the end walls 36 and 38.

Figure 4:
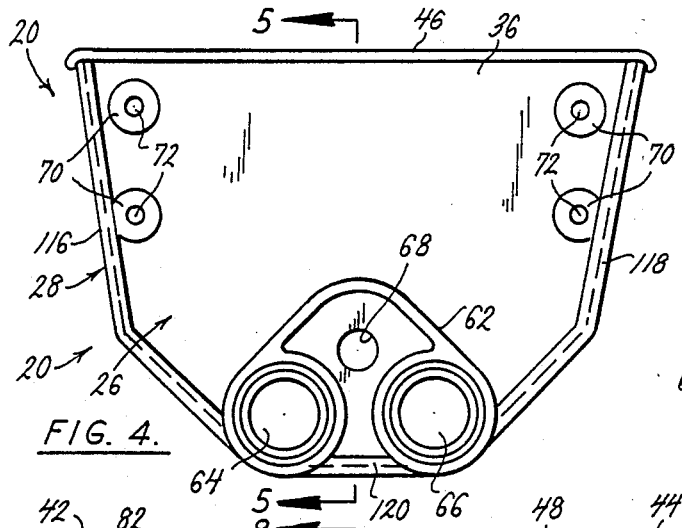
FIG. 4 is an enlarged elevation view of the connection end of the evaporator pan assembly.
Figure 5:
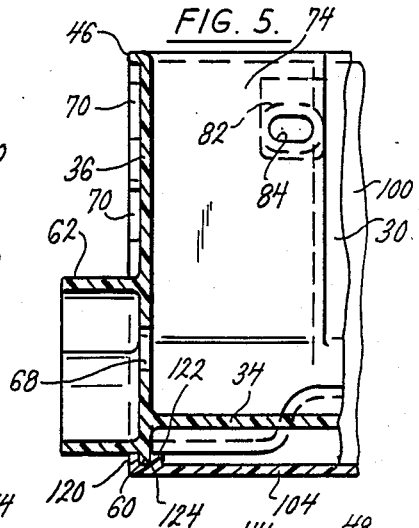
FIG. 5 is a partial view in section taken along the plane of the line 5—5 of FIG. 4.

A continuous groove 50 (FIG. 7) is formed in the under side of the sections 42, 44 and 48. The end wall 36 has a continuous laterally projecting flange 54 having side sections 56 and 58 that project beyond the side walls 30 and 32 and a bottom section 60 that projects below the bottom wall 34. The end wall 36 is also provided with a projecting hub 62 that has primary and secondary threaded ports 64 and 66 and a smaller overflow port 68 (see FIG. 4). The end wall 36 may also be provided with bosses 70 having holes 72 through them for receiving mounting screws.

The side wall 30 is provided with short sections 74 and 76 that are parallel to similar short sections 78 and 80 on the wall 32 for the purpose of positioning the lower end of the evaporator 24. There may be an outwardly projecting boss 82 opposite each wall section 74, 76, 78 and 80 with a longitudinally elongated hole 84 through each boss 82 for receiving a mounting screw.

Figure 7:
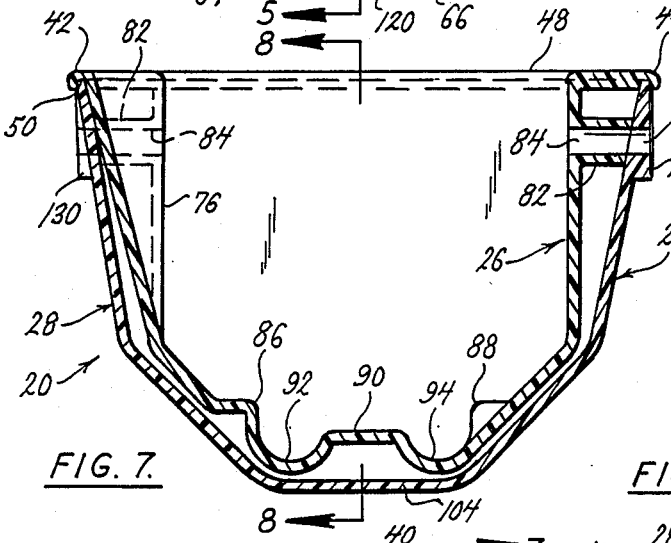
FIG. 7 is a view in section taken along the plane of the line 7—7 of FIG. 6.
Figure 8:
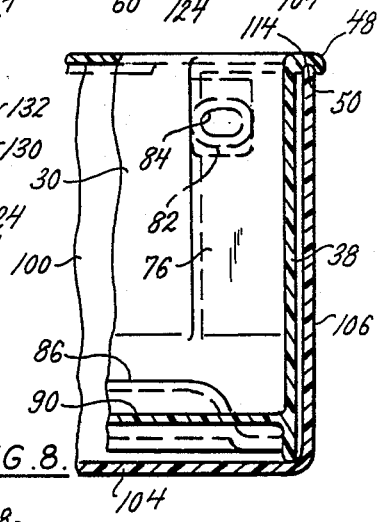
FIG. 8 is a partial view in section taken along the plane of the line 8—8 of FIG. 7.
Figure 6:
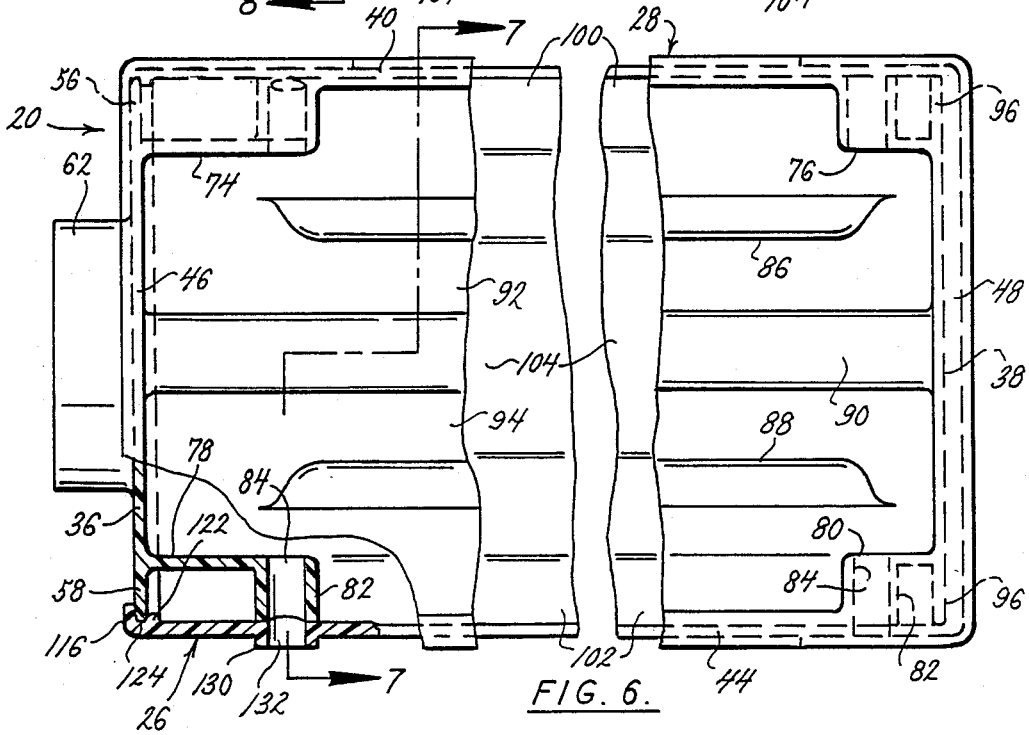
FIG. 6 is a top view of the evaporator pan assembly with portions shown in section.

Finally, the bottom wall 34 of the inner pan 26 preferably has longitudinally extending ribs 86 and 88 that project inwardly at 45° angles as is particularly illustrated in FIG. 7. Between the ribs 86 and 88, there is a raised central ledge 90 that cooperates with the ribs 86 and 88 to define two channels 92 and 94 that are aligned with the drain openings 64 and 66. These channels 92 and 94 for concentrate the flow of condensate water from the inner pan 26 through the appropriate drain opening 64 or 66.

The end wall 38 may be provided with lateral flanges 96 on its opposite sides for locating the end 38 of the inner pan 26 relative to the outer pan 28.

The outer pan 28 has side walls 100 and 102 that are inclined inwardly toward a bottom wall 104. The side walls 100 and 102 are spaced further apart than are the side walls 30 and 32 of the inner pan 26 and they are taller so that the bottom wall 104 of the outer pan 28 is lower than the bottom wall 34 of the inner pan 26 at the lowermost extremes defined by the channels 92 and 94. The outer pan 28 also has an end wall 106. There is a continuous upper edge 108 having side wall sections 110 and 112 and an end wall section 114.

The side walls 100 and 102 have inwardly projecting flanges 116 and 118 and the bottom wall 104 has an inwardly projecting flange 120. These flanges 116, 118 and 120 cooperate with a continuous bead 122 to define a groove 124 that is unbroken except for interruptions 126 and 128 between the flanges 116 and 118 and the bottom flange 120. There are bosses 130 in the side walls 100 and 102 and each boss 30 has a longitudinally elongated opening 132 through it.

ASSEMBLY AND USE

Installation of the embodiment of the drain pan assembly 20 that is illustrated is easy. The inner and outer pans 26 and 28 are each formed of injection molding. To assemble the inner and outer pans 26 and 28, the upper edge sections 110, 12 and 114 of the outer pan 28 are fitted into the continuous groove 50 in the ledge sections 42, 44 and 48, respectively, and the flange sections 56, 58 and 60 on the inner pan 26 are fitted into the groove 124 in the outer pan 28, all joints being fixed with plastic solvent to provide a strong fluid-tight seal.

The short wall sections 74, 76, 78 and 80 receive the lower end of an evaporator between them. When screws are tightened in the aligned openings 132 and 84 and into the evaporator housing, the outer pan walls 100 and 102 are pressed fluid-tight against the bosses 82.

With the inner and outer pans 26 and 28 joined together, as illustrated in FIGS. 2 and 4–8, the space between them provides a trapped wall of air that insulates the inner pan 26 from the outer pan. This allows the temperature of the outer pan 28, and in particular of its outer surface, to be at or close to the temperature of the room air, even though the temperature of the inner pan 26 is kept cold by the condensate water from the evaporator. As a result, condensation on the outer surface of the evaporator pan assembly 20 is essentially eliminated.

Although the end wall 36 is only a single thickness, it has a relatively small surface area compared to the overall surface area of the evaporator pan, and could be insulated by an outside pan; and it has been found that condensation on that end wall 36 is minimal. Keeping the end wall 36 in a single thickness simplifies the construction of this evaporator pan assembly while solving the condensation problem. On the other hand, if desired, it should be recognized that the end wall 36 could be made of a double-wall construction.

Since the end wall 38 of the inner pan 26 is connected only at its upper flange section 48 to the outer pan 28, the end wall 38 can move or float relative to the end wall 106 of the outer pan 28. This allows the inner pan 26 to contract relative to the outer pan 28 in response to the differences in temperature of the inner and outer pans 26 and 28. Yet, the expansion and contraction of the inner pan 26 can take place without breaking the seal of the air pocket between the inner and outer pans.

As is conventional, the evaporator 24 is frequently inclined and the evaporator pan assembly 20 inclined with it as illustrated in FIG. 1. This makes one of the drain openings 64 or 66 (the drain opening 66 in the installation as illustrated) the primary drain opening, and the other drain opening 64 would be plugged. The channel 94 also becomes the lowest part of the evaporator pan assembly in the inclined position and serves as a collection channel for the condensate flowing from the evaporator 24. The channel 94 being aligned with the drain opening 66, condensate is directed to the drain opening 66 and does not have a chance to overflow the lowered side 44 of the evaporator pan assembly 20.

Also, the ribs 86 and 88 form air restrictions, restricting the flow of air between them and the bottom of the evaporator. This prevents such air flow from washing condensate over the lowered edge of the evaporator pan assembly 20 in the inclined installation illustrated in FIG. 1. These ribs 86 and 88 are accommodated in the dual wall evaporator construction of the present invention, and the channels 92 and 94 are also accommodated, all without interrupting the insulating air wall.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. An evaporator pan assembly comprising an inner pan having walls defining a pan capable of containing water and having an open side, an outer pan having walls surrounding at least most of the walls of the inner pan and spaced therefrom, the space between the inner and outer pan walls defining an air wall, means for rendering the air space fluid tight, and means defining a channel in a lower portion of the inner pan for concentrating the collection of liquid, and a drain opening through a wall of the inner pan communicating with the channel.

2. The evaporator pan assembly of claim 1 wherein the rendering means comprises tongue and groove connections between the inner and outer pans.

3. The evaporator pan assembly of claim 2 including two spaced parallel channels in the lower portion of the inner pan, a pair of drain openings through a wall of the inner pan, each drain opening communicating with one of the channels whereby the pan assembly can be installed at an inclination that positions one of the channels at the lowest location in the pan assembly.

4. The evaporator pan assembly of claim 1 wherein the inner pan has bosses extending through the air space into contact with the outer pan and the inner and outer pans have aligned holes that extend through the bosses for receiving mounting screws that, when tightened, tighten the outer pan against the adjacent end of the bosses in a fluid-tight seal while providing a mounting means to mount the evaporator pan to an evaporator.

5. An evaporator pan assembly comprising an inner pan having a bottom wall, side walls and end walls joined together to form a pan having an open upper side, a laterally outwardly projecting continuous flange contiguous with the sides and one end of the inner pan, an outer pan having sides and ends with upper edges, means for joining the upper edges of the sides and one end of the outer pan in a fluid-tight seal to the outer margins of the continuous flange, means for providing a fluid-tight connection between the side walls of the outer pan and the other end of the inner pan, and at least two drain openings and an overflow opening through said other end of the inner pan.

6. The evaporator pan assembly of claim 5 wherein the joining means comprises a continuous groove in the lower side of the continuous flange and wherein the upper edge of the outer pan is received within the continuous groove and joined thereto with gluing.

7. The evaporator pan assembly of claim 6 wherein the inner and outer pans are of plastic and the gluing means comprises a plastic solvent.

8. An evaporator pan assembly comprising a plastic inner pan, a plastic outer pan, the plastic inner pan having side and bottom walls, and the plastic outer pan having side and bottom walls spaced outwardly from the side and bottom walls of the inner pan and joined at their upper extremes to the upper extremes of the side and inner walls of the inner pan, the side walls of the inner pan being inwardly inclined toward the bottom wall, and flat sections on the inner pan side walls, the flat sections being parallel to one another and being spaced apart by a distance about equal to the width of the lower portion of an evaporator for receiving said evaporator lower portion between the wall sections.

9. The evaporator pan assembly of claim 8 wherein at least one side wall of the inner pan is free of connections to the outer pan other than at its upper extreme so that the inner pan side wall can move relative to the adjacent outer pan side wall.

10. An evaporator pan assembly comprising:

an inner pan having side walls and a bottom and an open top defining a pan capable of containing water;

an outer pan having side walls and a bottom surrounding the bottom and all but one of the side walls of the inner pan and spaced therefrom leaving the one side wall of the inner pan uncovered by the outer pan and having an open top whereby an evaporator can be introduced through the open top into the area between the side walls of the inner pan, the space between the inner pan and the outer pan defining an air space, and means for rendering the air space fluid tight.

11. The evaporator pan assembly of claim 10 wherein:

the rendering means comprises tongue and groove connections between the side walls of the inner and outer pans.

12. The evaporator pan assembly of claim 10 wherein:

the inner pan has four side walls and the outer pan has three side walls.

13. The evaporator pan assembly of claim 10 wherein:

said one of the side walls of the inner pan having at least one drain opening extending therethrough.

* * * * *